United States Patent [19]

Prezas

[11] Patent Number: 4,561,102

[45] Date of Patent: Dec. 24, 1985

[54] PITCH DETECTOR FOR SPEECH ANALYSIS

[75] Inventor: Dimitrios P. Prezas, Chicago, Ill.

[73] Assignee: AT&T Bell Laboratories, Murray Hill, N.J.

[21] Appl. No.: 420,234

[22] Filed: Sep. 20, 1982

[51] Int. Cl.[4] ..... G10L 1/00

[52] U.S. Cl. ..... 381/49

[58] Field of Search ..... 381/49, 29–48, 381/50; 364/513, 513.5

[56] References Cited

U.S. PATENT DOCUMENTS

| | | | |
|---|---|---|---|
| 3,631,520 | 12/1971 | Atal | 179/1 |
| 3,740,476 | 6/1973 | Atal | 179/1 |
| 3,975,587 | 8/1976 | Dunn et al. | 381/49 |
| 4,081,605 | 3/1978 | Kitawaki et al. | 381/49 |
| 4,282,405 | 8/1981 | Taguchi | 381/49 |
| 4,282,406 | 8/1981 | Yato et al. | 381/49 |

*Primary Examiner*—E. S. Matt Kemeny
*Attorney, Agent, or Firm*—Jack S. Cubert

[57] ABSTRACT

A pitch detector for human speech is based on a time domain, linear predictive coding (LPC) analysis of the residual wave resulting from the elimination of the vocal tract transfer function from the composite speech wave or its Hilbert transform. Periodicity among pulses of greatest amplitude in equal-length speech frames is systematically tested in the residual wave. When periodicity is found within and between adjacent frames, the instant frame is determined to be voiced and the pitch frequency is stored. When no periodicity is measured, the frame is determined to be unvoiced; and the noise power is stored. From the voiced/unvoiced decision, the pitch period, the pulse amplitude, the noise power and the (LPC) parameters stored in a compact register and the original speech can be synthesized. Concurrent determination of the voiced/unvoiced character of every frame and the pitch period of voiced frames is made possible without the use of absolute amplitude thresholds.

9 Claims, 11 Drawing Figures

FIG. I
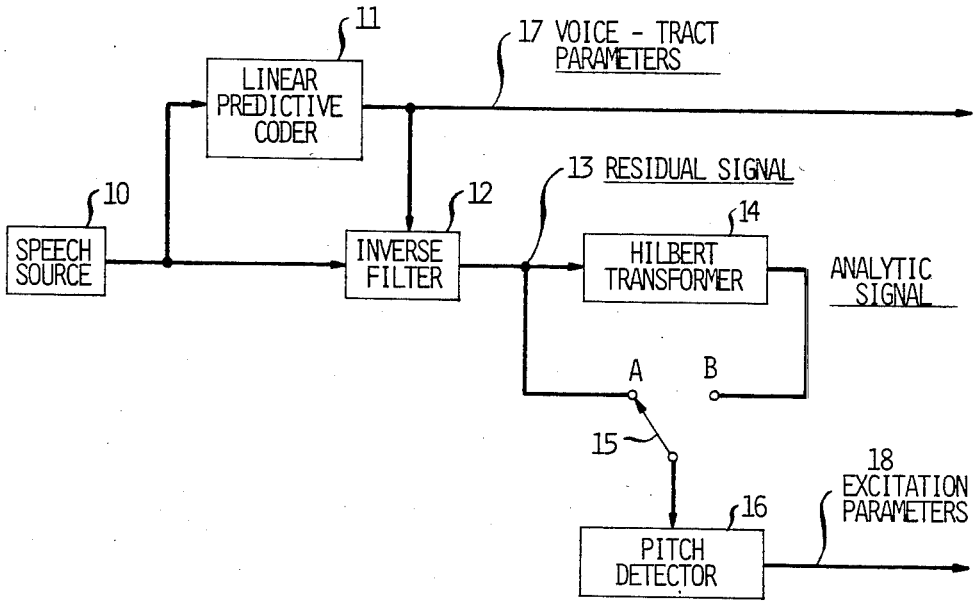
FIG. II
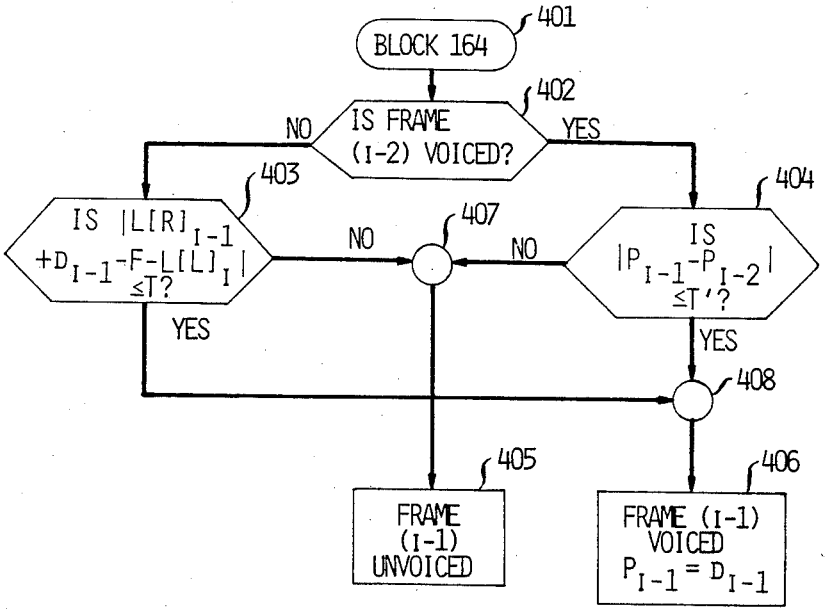

PITCH DETECTOR FOR SPEECH ANALYSIS

FIELD OF THE INVENTION

This invention relates generally to digital coding of human speech signals for compact storage and subsequent synthesis and, more particularly, to pitch detection and the simultaneous determination of the voiced or unvoiced characterization of discrete frames of speech.

BACKGROUND OF THE INVENTION

Digital coding of human speech for the purposes of compact storage and conservation of transmission bandwidth has been practiced for many years. A principal object of speech coding is to minimize the number of bits per second required to be stored for acceptable quality of speech reproduction in voice answerback and announcement applications. Analog speech samples are customarily partitioned into frames or segments of discrete length (assumed to be stationary) on the order of 20 milliseconds in duration. Sampling is typically performed at a rate of six to ten kiloHertz (kHz) and each sample is coded into a multibit digital number. Successive coded samples are further processed in a linear prediction coder (LPC) whose function is to determine the appropriate predictor parameters which can be used to estimate present values of each signal sample efficiently on the basis of the weighted sum of a preselected number of prior sample values. The parameters representing the LPC weights applied to prior sample values are related, as is well known, to the formant structure of the vocal tract transfer function. The speech signal is regarded analytically as being composed of an excitation signal and a formant transfer function. The excitation component arises in the larynx or voice box and the formant component results from the operation of the remainder of the vocal tract on the excitation component. The excitation component is further classed as voiced or unvoiced, depending upon whether or not there is a fundamental frequency imparted to the air stream by the vocal cords.

The LPC coefficients are made adaptive to the mean-square of the difference between the predicted value and the actual value at each sampling instant. The result is that the coefficient values vary slowly from one speech frame to another. These weighting coefficients and a gain factor to account for the average speech energy level constitute the LPC parameters that must be stored and made available to a speech synthesizer. The remaining information required by a speech synthesizer comprises the mode of excitation, i.e., voiced or unvoiced, and the pitch, or fundamental, period of voiced sounds.

Adaptive predictive coding of speech signals is taught by B. S. Atal in his U.S. Pat. No. 3,631,520 granted on Dec. 28, 1971.

It is further known from U.S. Pat. No. 3,740,476 issued June 19, 1973 to B. S. Atal that an adaptive LPC network models the envelope of the speech signal spectrum and can therefore be employed as an inverse filter to subtract the formant structure from the raw speech signal. The resultant residual wave accounts for the fine spectral structure of the speech waveform and approximates the excitation function of the vocal tract. In effect the speech spectrum is flattened to emphasize the glottal pulses when the excitation is voiced.

It is an object of this invention to provide an improved pitch detector which operates on the residual wave remaining after removal of the vocal tract shaping function from the speech signal.

SUMMARY OF THE INVENTION

According to this invention, pitch detection in time domain linear predictive coding (LPC) analysis of human speech is effected in real time from the residual wave approximating the excitation structure of the vocal tract or the Hilbert transform thereof without the use of absolute amplitude thresholds for identification of the glottal pulses. Moreover, a voiced/unvoiced decision is concluded simultaneously without additional signal processing.

After dividing digitally encoded speech samples into frames or segments of uniform length, the frames are examined one by one to measure the amplitude and location of: first, the pulse of maximum amplitude and subsequently all other pulses of successively lower amplitude exceeding some preselected fraction of the maximum amplitude and separated from prior pulses by a minimum distance related to the fundamental pitch frequency range of the human voice. Upon identifying and storing the locations of all candidate pulses a reordering by location is made. Distance measurements taken left and right from the pulse of maximum amplitude are examined for equal spacing to establish periodicity, where possible, within a frame and between adjacent frames. A finding of periodicity within a frame establishes an initial pitch value and completes the pitch determination and makes a voiced decision in conjunction with measurements and decisions obtained for previous and following frames. A failure to find periodicity over a span of three speech frames establishes an unvoiced decision. As an auxiliary measurement, the total energy of successful candidate pulses within each voiced frame is determined. The noise energy is measured in unvoiced frames.

A significant advantage of the avoidance of a predetermined absolute amplitude threshold for the pitch pulses is that their tracking becomes independent of voiced sound power, as well as, whether the talker is male or female, adult or child.

BRIEF DESCRIPTION OF THE DRAWING

The above and other objects and advantages of this invention will be more fully appreciated from the following detailed description and the drawing in which:

FIG. 1 is a generalized block diagram of a linear predictive coding arrangement for time domain speech analysis;

FIG. 11 is a flowchart showing a routine for final determination of the pitch period and voiced/unvoiced decision based on previous and next frames.

DETAILED DESCRIPTION OF AN ILLUSTRATIVE EMBODIMENT

Figure 2:
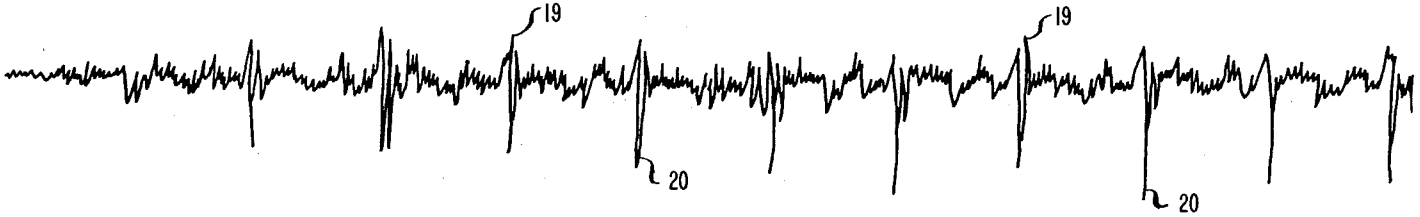
FIG. 2 is a waveform diagram of a residual wave representation of a frame of human speech.

A linear predictive coding (LPC) analysis of a segment or frame of human speech, according to Atal, for example, provides a speech synthesizer with two groups of information, both of which are necessary for intelligible playback. The first group is a set of coefficients describing the structure of the synthesis filter, usually in nonrecursive transversal form where weighted past speech samples are combined to form an estimate of the succeeding sample. The second group is a set of parameters needed for the generation of its excitation. For the frame containing only "unvoiced" energy a random noise excitation with controlled power level is sufficient for the complete characterization of the synthesizers driving function. For the frame containing "voiced" energy there is observed a periodic pulse train whose pulse period, or pitch, and power level must be measured.

A speech sound is said to be voiced when the vocal cords must be brought into oscillation to produce it. A speech sound is unvoiced when it is brought into being through turbulence of air shaped by the vocal tract without vibration of the vocal cords. It is fundamental to speech analysis to be able to make a voiced/unvoiced (v/u) decision about each frame of speech. Due to the fact that some speech sounds contain both periodic pulses and random noise it is not a straightforward matter to make the v/u decision. Most known pitch detection schemes assume that the v/u decision is obtained independently of, and prior to, pitch detection by such means as autocorrelation, time waveforms and frequency waveforms. These known schemes rely ultimately on the utilization of absolute amplitude thresholds. Due to the diversity of speakers and the variability of their speech levels the use of such amplitude thresholds tends to be unreliable in practice.

LPC analysis utilizes the inverse filter technique to determine the parameters which describe the resonant structure of the vocal tract for a fixed speech frame as distinguished from the vibratory effect of the vocal cords. The inverse filter transfer function is a good approximation of the reciprocal of the smoothed speech spectrum, which represents in a practical way the resonance characteristics of the vocal tract. The operation of the inverse filter on the speech wave results in a residual wave from which the resonance effects of the vocal tract have been removed and the pitch pulses in the voiced speech segments are emphasized. The pitch period is then broadly the time difference between pairs of samples of the residual wave. Genuine pitch pulses are unfortunately contaminated by the presence of noise pulses. Heretofore, reliance was made on the selection of an amplitude threshold to distinguish between spurious noise and true pitch pulses. This reliance is often unsatisfactory, particularly for quiet speakers and different types of voiced sounds.

FIG. 1 depicts the basic LPC analysis system useful in the practice of this invention. The system comprises speech source 10, linear predictive coder 11, inverse filter 12, Hilbert transformer 14 and pitch detector 16. Coder 11 samples speech from source 10 at a Nyquist rate, such as 8 kHz, and digitizes the sample amplitudes. Pluralities of such samples over an illustrative frame length of 160 are weighted and combined adaptively with each actual sample to find the best least square fit to the gross envelope behavior of the speech spectrum. The weighting values become the vocal tract parameters needed by a speech synthesizer. In addition to being made available on output line 17, the voice tract parameters are delivered to inverse filter 12 which in effect subtracts from the speech signal out of source 10 the vocal tract resonances to create the residual signal at junction 13.

FIG. 2 is the waveform of a representative residual speech signal showing positive and negative pulses 19 and 20, by way of example.

Figure 3:
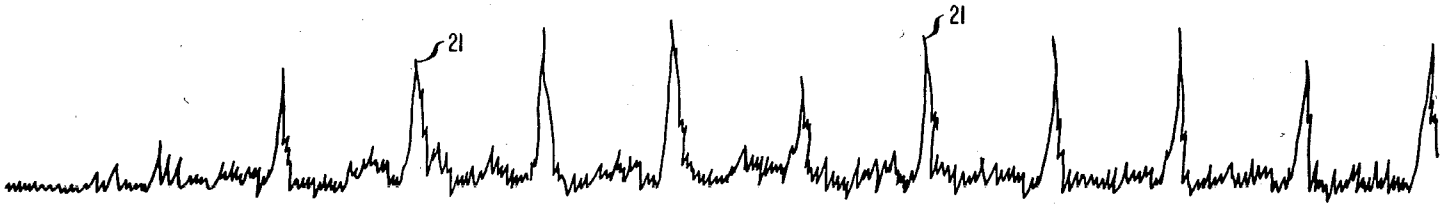
FIG. 3 is the Hilbert envelope of the residual wave of FIG. 2.

FIG. 3 is the envelope waveform of the analytic signal resulting from the operation of Hilbert transformer 14 on the residual signal of FIG. 2. A Hilbert transformer effectively rotates all frequency components of a signal through an angle of ninety electrical degrees. As shown in FIG. 3, the analytic envelope waveform renders the pulses, such as 21, more distinct and of like polarity and tends to remove variations due to group delay in the vocal tract.

By means of transfer switch 15 the raw residual signal at contact A or its analytic equivalent at contact B can be selectively applied to pitch detector 16, as desired. Pitch detector 16, which generates the desired excitation parameters of pitch frequency and energy level, forms the subject matter of this invention.

Figure 4:
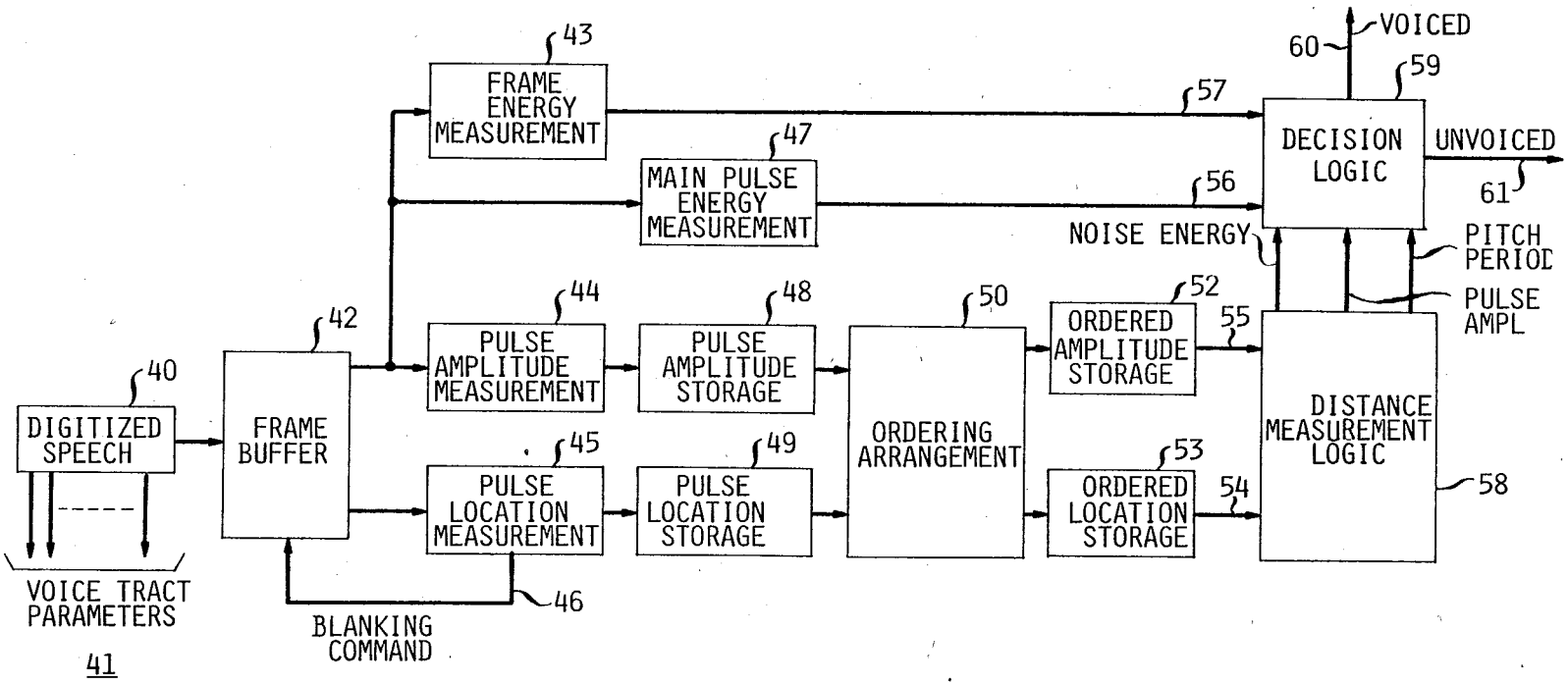
FIG. 4 is a simplified block diagram of a pitch detector for human speech according to this invention.

FIG. 4 is a simplified block diagram of an arrangement according to this invention for pitch detection in speech analysis systems which do not rely on fixed amplitude threshold levels.

Assume a limited fundamental frequency range for human speech extending between 50 Hz and 400 Hz. This choice implies that the pitch period, measured in 8 kHz samples, varies from 160 (8000/50) samples to 20 (8000/400) samples. Thus, a frame width of 160 samples is equal to the highest pitch period, i.e., lowest fundamental frequency.

FIG. 4 comprises digitized residual envelope source 40, frame buffer 42, frame energy measurement block 43, pulse amplitude measurement block 44, pulse location measurement block 45, main pulse energy measurement block 47, pulse amplitude storage block 48, pulse location storage block 49, ordering arrangement 50, ordered amplitude storage block 52, ordered location storage 53, distance measurement logic 58 and decision logic 59.

Digitized residual envelope source 40 is substantially the apparatus of FIG. 1 in condensed form. Voice tract parameters on leads 41 are the same as those shown at lead 17 in FIG. 1. One hundred sixty samples of a residual frame are stored in frame buffer 42 while the frame is being processed. First, the total energy in the speech frame is measured by frame energy measurement block 43 in a conventional manner. Next, the amplitudes of the pulses in each frame are measured in the order of decreasing height from the maximum and the respective amplitudes and locations by sample number are stored in pulse amplitude storage 48 and pulse location storage 49. As each pulse is located a blanking command over lead 46 is sent to buffer 42 to zero all sample values plus and minus 18 therefrom because the highest 400 Hz frequency expected has a period spanning 20 samples at the 8 kHz rate. A margin for measurement error is factored into the selection of the number 18 rather than 20. The candidate pulses stored in blocks 48 and 49 are reordered or unscrambled in ordering arrangement 50 by location index and the results are stored in ordered amplitude storage 52 and ordered location storage 53, respectively. As a secondary criterion to the elimination of pulses closer than ±18 samples from candidate pulses, pulses after the maximum are compared with the maximum in amplitude and those less than one-quarter of the maximum amplitude are eliminated on empirical grounds.

Distance measurement logic 58 now processes the ordered information in storages 52 and 53 to decide whether multiple pulses are evenly spaced, with a small arbitrary "breathing" margin for measurement error, from the maximum pulse. Even spacing, where it exists, is taken as the pitch period. Where only two pulses occur, their spacing indicates the pitch period. Where only one pulse occurs, its position with respect to a pulse in an adjacent frame must be considered to measure the pitch period.

The pitch period, if measurable within the frame, is passed on to decision logic 59. Decision logic 59 determines the pitch period from previously stored information on pulse position and pitch in a prior and following frame. Decision logic 59 is also supplied with frame and main pulse energy over leads 56 and 57. The presence of periodicity in decision logic 59 provokes a voiced decision output on lead 60. The absence of periodicity causes an unvoiced decision output signal on lead 61.

The logical operations outlined above and in FIG. 4 are capable of realization in real time with currently available microprocessors such as the type SPS-41, 61 or 81 made by Signal Processing Systems of Waltham, Mass. and described in the SPS 81 *Signal Processor User's Manual,* copyrighted 1975, by Signal Processing Systems, Waltham, Mass. Its use in speech processing is described in the article, "Real-Time Linear-Predictive Coding of Speech on the SPS-41 Triple-Microprocessor Machine," by Michael J. Knudsen, appearing in the *IEEE Transactions on Acoustics, Speech and Signal Processing,* Vol. ASSP 23, No. 1, February 1975, pp. 140–145.

Figure 5:
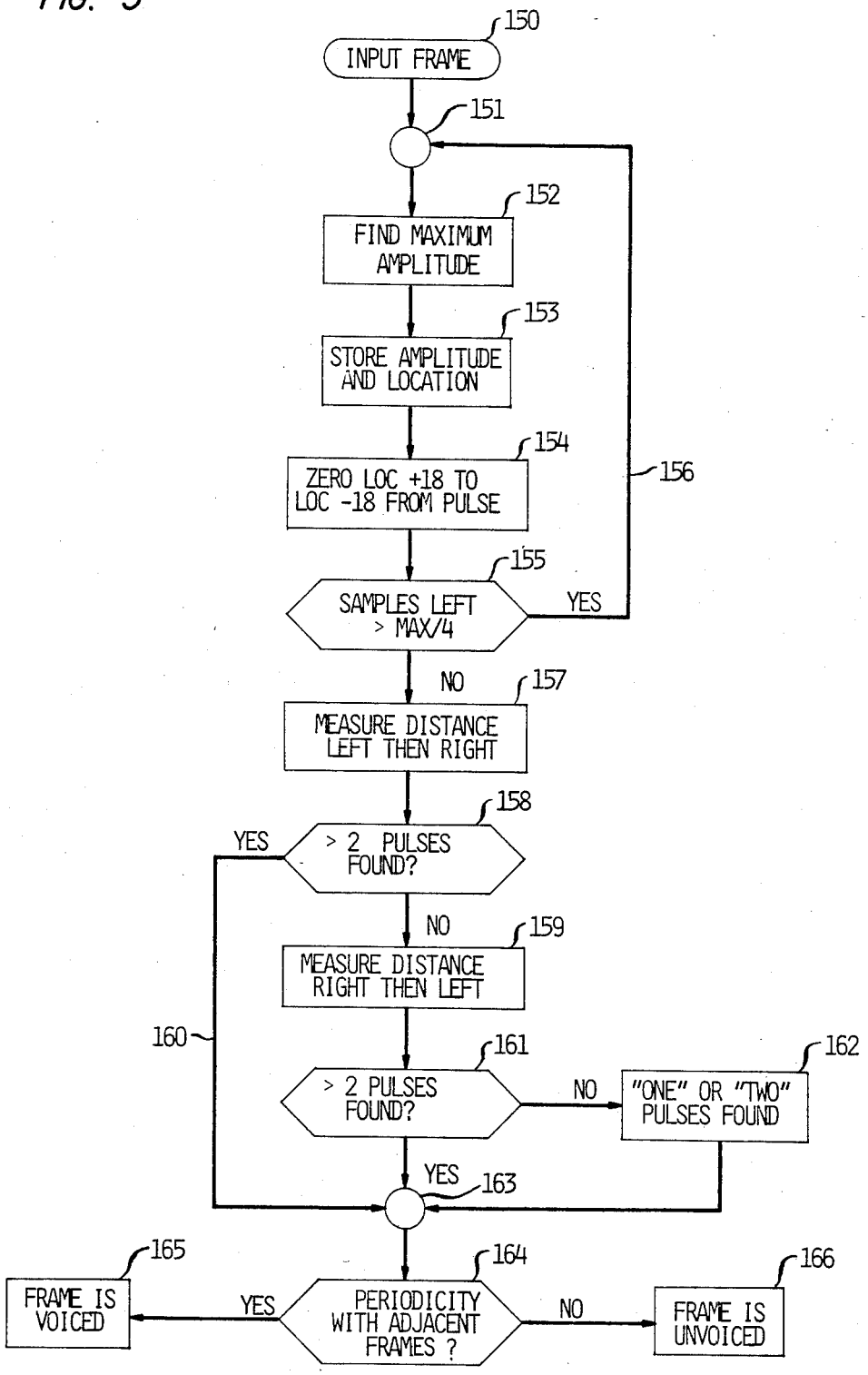
FIG. 5 is a simplified flowchart showing the method of operation of the pitch detector of FIG. 4.

FIG. 5 is a flowchart governing the sequential order logic operations of the arrangement of FIG. 4. This flow chart and the detailed flow charts of FIGS. 8–11 may, as is well-known in the art, be coded into sequenced instructions that are permanently stored to control the operations of the aforementioned microprocessor. Each 160-sample speech frame stored in frame buffer 42 is assumed at the outset to be voiced and therefore a search for candidate pitch pulses begins.

Figure 6:
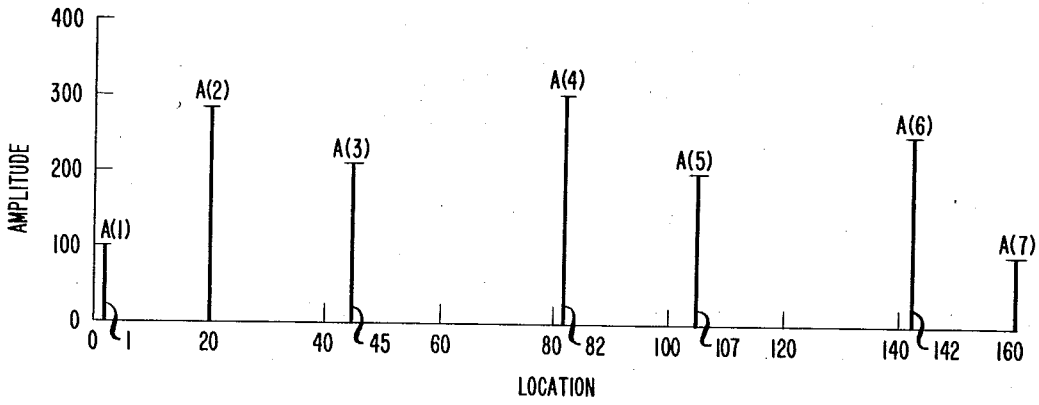
FIG. 6 is a first representative array of candidate pulses spanning a frame of human speech for purposes of explanation of the flowchart.

FIG. 6 represents a typical speech frame in which seven pulses of significant amplitude are observed in the residual wave at the locations indicated. Locations are indexed by sample number. First, the maximum amplitude sample A(4) at amplitude 300 millivolts, for example, is found at block 152 after being presented at input frame location 82. Its amplitude and location are stored in blocks 44 and 45 of FIG. 4, as directed in block 153. In accordance with the instructions in block 154 all sample values surrounding the maximum with the ±18 location range are blanked to zero amplitude. The search continues one-by-one for pulses whose amplitudes exceed by an arbitrary amount, say 25%, of the maximum amplitude until decision diamond 155 registers a negative decision. For each positive decision a new candidate is called from the input frame, as indicated by path 156 and connector 151. As each pulse is located in order of decreasing amplitude, the neighboring sample amplitudes are reduced to zero. From the example of FIG. 6 the following array of candidate pulses in order of decreasing amplitude with their locations is observed.

TABLE I

| Amplitude | Location |
|---|---|
| AA(0) = 300 | LL(0) = 82 |
| AA(1) = 280 | LL(1) = 20 |
| AA(2) = 250 | LL(2) = 142 |
| AA(3) = 210 | LL(3) = 45 |
| AA(4) = 200 | LL(4) = 107 |
| AA(5) = 100 | LL(5) = 1 |
| AA(6) = 90 | LL(6) = 160 |

The ordering function of block 50 of FIG. 4 is not repeated in FIG. 5. However, before proceeding with blocks 157 and 158 of FIG. 5, it is necessary to rearrange the entries of TABLE I to place the candidate pulses in order of occurrence from left to right as shown in TABLE II.

TABLE II

| Amplitude | Location |
|---|---|
| A(1) = 100 | L(1) = 1 |
| A(2) = 280 | L(2) = 20 |
| A(3) = 210 | L(3) = 45 |
| A(4) = 300 | L(4) = 82 |
| A(5) = 200 | L(5) = 107 |
| A(6) = 250 | L(6) = 142 |
| A(7) = 90 | L(7) = 160 |

The assumption is now made that the pulse of maximum amplitude A(4) is most probably a valid candidate. This pulse position is adopted as a reference point for periodicity testing. According to block 157 of FIG. 5, a search for periodicity is carried out in a systematic way first to the left and then to the right of the location of the pulse of maximum amplitude. A look to the left shows pulse A(3) at location 45 to be $\Delta=37$ samples from the maximum pulse A(4). If the period were 37, then there should be a pulse at location $45-37=8$; there is no such pulse. The next two pulses A(2) and A(1) are then 12 and 7 samples away from location 8. Allowing a breathing space of $T=5$ for observation error, pulse A(3) at location 45 cannot be a valid pulse candidate for periodicity determination.

This process is then repeated by considering pulse A(2) as the legitimate pulse to the left of pulse A(4). Accordingly, we have $\Delta=62$. If the period were 62, then there should be a pulse at location $20-62=-42$, which falls outside the frame under consideration.

According to block 157, the search for periodicity continues to the right. If the period were 62, then there should be a pulse at location $82+62=144$. Allowing a breathing space of $T=5$, pulse A(6) is found to be valid pulse candidate at location 142. Finally, based again on the most recent ($\Delta=62$) period, there should be a pulse at location $142+62=204$, which falls outside the present frame. Thus, the response to decision block 158 is clearly "yes" and three candidate pulses are located at spacings with an average pitch period value of $(142-20)/(3-1)=122/2=61$.

Block 159 would have been utilized if all initial searches to the left of pulse A(4) and the test of decision diamond 158 had failed. In decision block 161 the test for pulses in excess of two is repeated. In the event of a positive decision, the test for periodicity with a pulse in an adjacent frame is undertaken.

In the event of a negative decision in block 161, a further determination is made in block 162 whether one or two pulses are present in the frame. In any event the test of block 164 for periodicity with an adjacent frame is undertaken and the frame is finally determined to be voiced or unvoiced in blocks 165 or 166.

Figure 8:
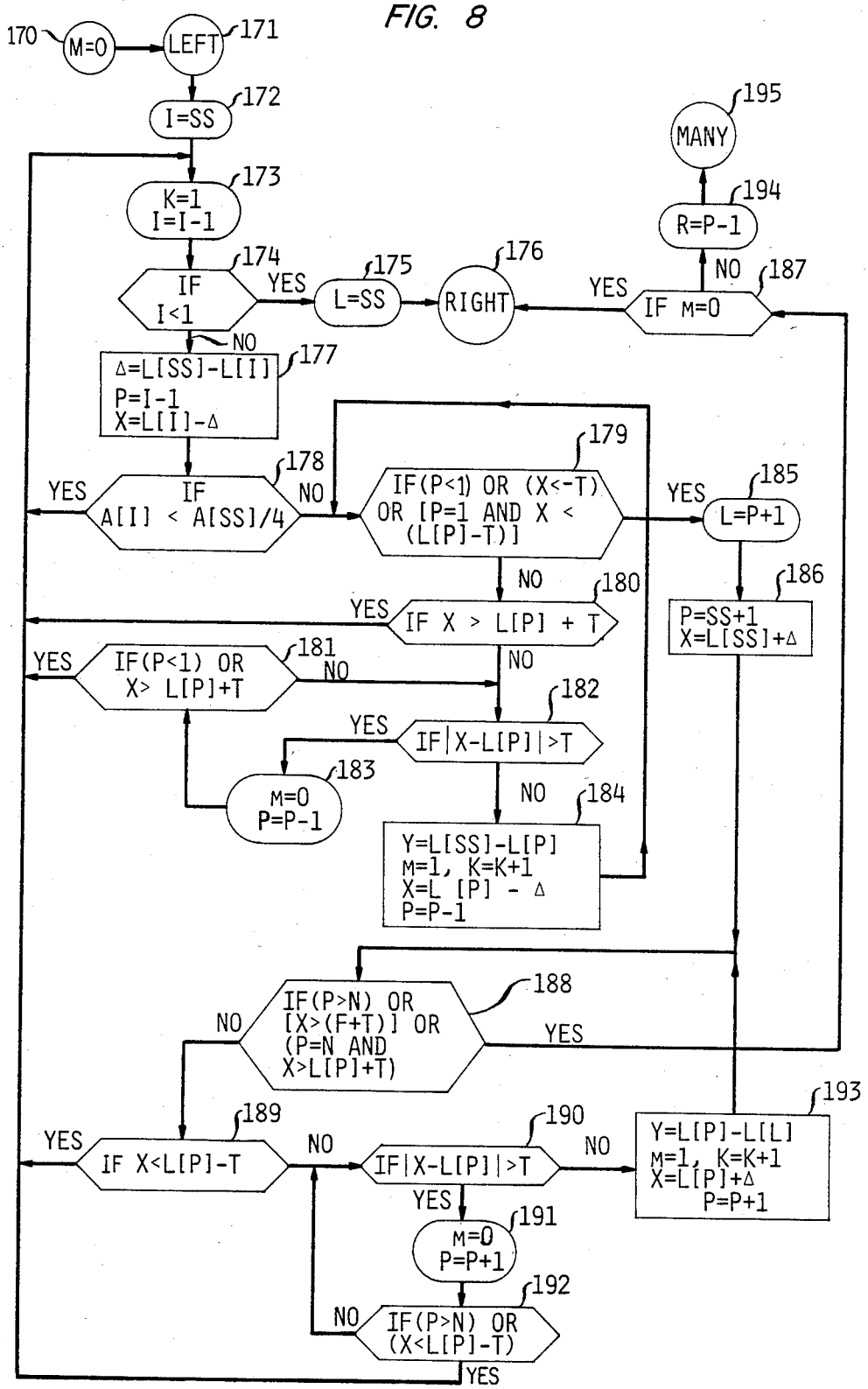
FIG. 8 is a detailed flowchart showing a routine for estimating the periodicity of the pulses in the residual wave involving an initial search to the left of the principal pulse in a speech frame.

A more detailed flowchart of the search to the left of the reference pulse is shown in FIG. 8. Using the example pulse candidates of FIG. 6, begin by locating the pulse of maximum amplitude at $I=SS=4$ (block 172) and select with index $k=1$ the next pulse to the left at new $I=3$ (block 173), at the same time checking (block 174) that I has not become negative to indicate that the frame limits have been exceeded. A distance differential $\Delta$ is calculated (block 177) from the location parameters L(4) and L(3) as set forth in TABLE II as $82-45=37$, which exceeds the blanking number 18. Calculate pseudo-index $$P=I-1=2,$$

and also calculate $$X=L(I)-\Delta=L(3)-\Delta=45-37=8$$

to test for periodicity. Save these values. Ascertain (block 178) that the amplitude of the pulse under observation is greater than 25 percent of that of the largest pulse. If it is not, select the next pulse. If it is so, determine (block 179) whether P is less than 1 or X is less than $-T=-5$, the arbitrary breathing distance. The answer is no in both cases in this example. Determine further, where $P=1$, whether X is less than $$L(P)-T=L(2)-5=20-5=15.$$

This test is not applicable to this example. However, the last pulse to the left has not been reached. Therefore, continue with $20+T=25$ (block 180), which is greater than $X=8$, to determine whether or not to consider that pulse 2 coincides with the pseudopulse X. The answer here is positive. Proceed next to check the absolute spacing of the pseudopulse X and real pulse A(2) (block 182). Here that value is 17, which is greater than $T=5$. Therefore, the decision (block 183) is that $m=0$, which is to say that pulse A(3) is not periodic with any other pulse and therefore is an unsuccessful candidate. Also, reduce P by one unit and perform the test of block 181 to ascertain that there is no other left pulse candidate periodic with pulse 3. The result here, is that pulse A(1) is invalid, since $L[P]+T=1+5=6$ is less than $X=8$.

Thus, return to block 173 and test pulse A(2) at location 20. For this test $\Delta$ becomes 62 in block 177. Subtracting 62 from 20 yields location $-42$. Performance of the tests of block 179, leads to block 186 with $L=2$ indicating that the leftmost candidate is A(2).

After taking a new $P=SS+1=4+1=5$ in block 186, pulse 5 at location 113 is tested against $X=L(SS)+\Delta=82+62=144$. Pulse A(5) does not fall within the breathing space of $T=5$ (block 190) of pulse X and therefore is not a valid candidate. The tests specified in block 188 are complementary to those in block 179 and are for the purpose of determining when the rightmost candidate pulse is reached. However, the last pulse to the right has not yet been reached. Therefore, continue at block 191 with $P=6$ and $L[P]-T=142-5=137$.

Checking of the absolute spacing of pseudopulse X and real pulse A(6) in block 192 determines that pulse A(6) is within the breathing space of pulse X obtained by adding $\Delta$ to the main pulse location 82.

Proceed now to block 193 and determine the distance between pulse A(6) and the leftmost pulse as $142-20=122$. It is thus confirmed that pulse A(6) is valid. Now add $\Delta$ to the location of pulse A(6) to obtain another pseudopulse location 204 and search for a real pulse there.

Next go on to pulse A(7) at location 160 and again perform the tests of block 188 that eventually leads to block 194. From the tests of block 193 it has been determined that the distance between the leftmost and latest candidate is $Y=122$ and that the number of successful candidates, less one, is $K=2$. The quotient of Y and K yields the average pitch period of 61 samples, the equivalent of $8000/61=131$ Hz.

The legitimate pulse A(6) is also tested in block 188 and is found to be the rightmost successful candidate. This yields a "no" answer in block 187. The calculation in block 194, namely: $R=P-1$, yields the rightmost pulse as A(6). Block 195 indicates that this routine is complete and the conclusion is that there exist more than two successful pulse candidates.

If the rightmost pulse A(6) had been found to be invalid, block 187 would have directed the tests to circle 176, labelled RIGHT. At that point the flowchart of FIG. 9 would be used. This flowchart is essentially the mirror image of that shown in FIG. 8. According to the flowchart of FIG. 9, the search for pulse candidates begins to the right of the pulse of maximum amplitude. The several test and decision blocks in FIG. 9 correspond to similar blocks in FIG. 8 with the designators increased by 100 to a two-hundred series. The differences, for example, between diamond 179 in FIG. 8 and diamond 279 in FIG. 9 extend only to the order of the pulses being tested: as to whether pulse P is numerically less than 1 (leftmost) or greater than N (rightmost) when determining whether all pulses have been tested. Similarly, block 193 in FIG. 8 differs from block 293 in FIG. 9 in making Y (the distance between extreme left and right pulses) equal, respectively, to the differences between the last pulse in question and the extreme left or extreme right pulse.

Figure 7:
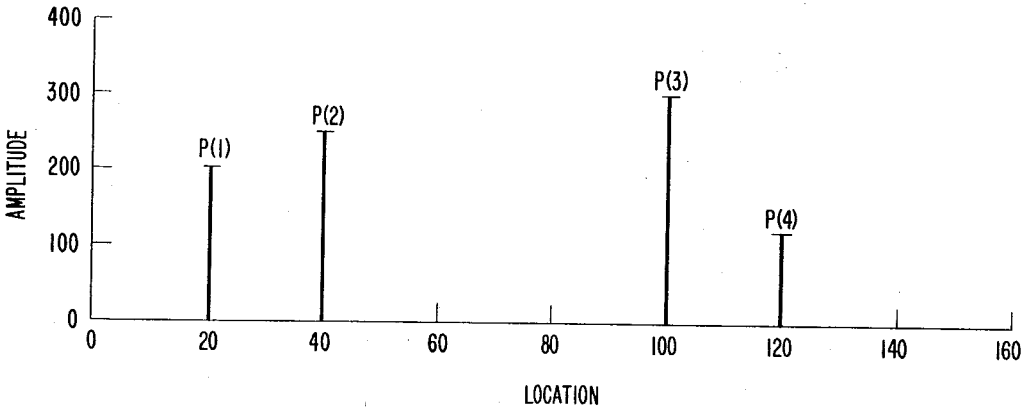
FIG. 7 is a second representative array of candidate pulses spanning a frame of human speech for explanatory purposes.
Figure 9:
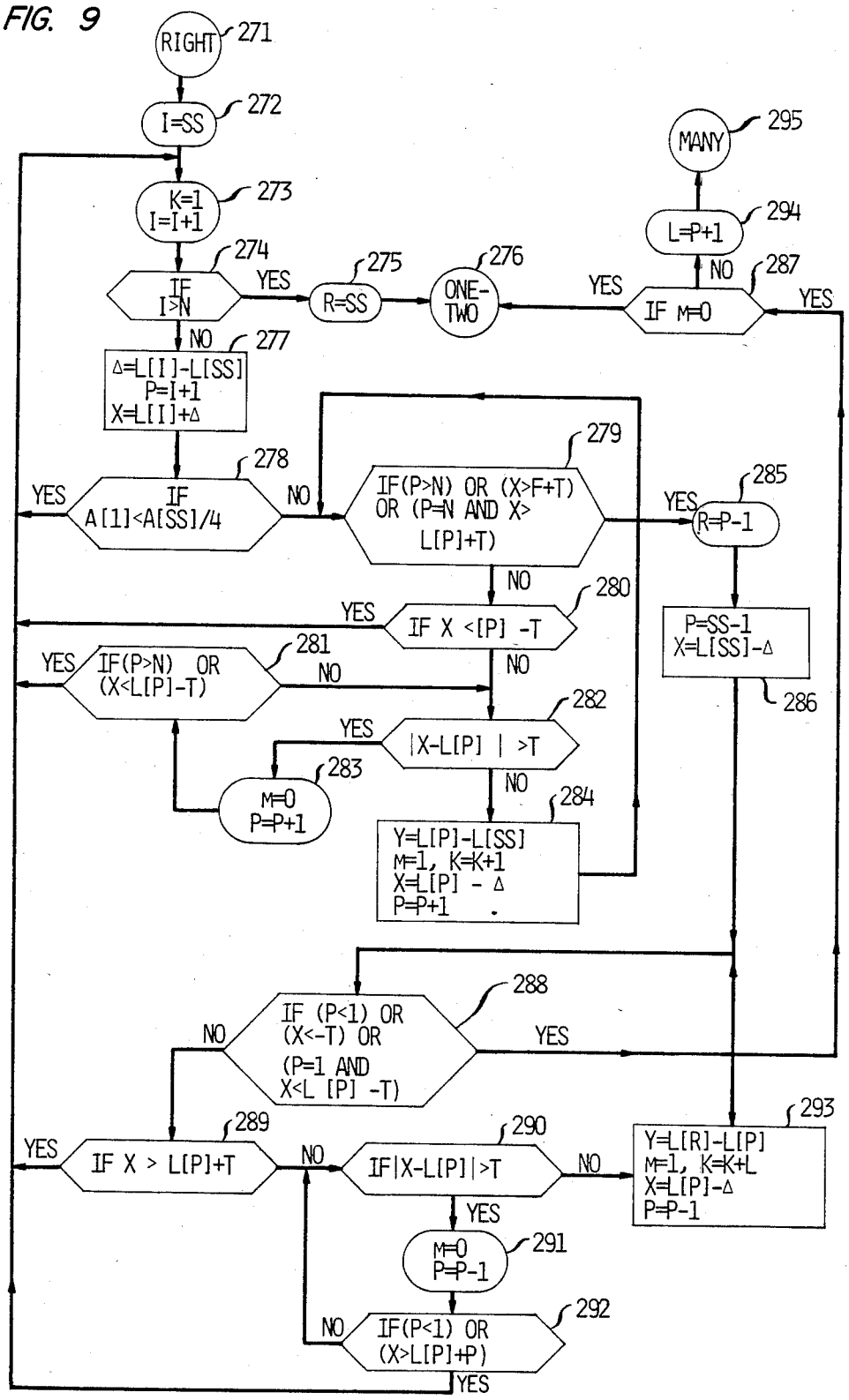
FIG. 9 is a detailed flowchart showing a routine for estimating the periodicity of pulses in the residual wave involving an initial search to the right of the principal pulse in a speech frame.
Figure 10:
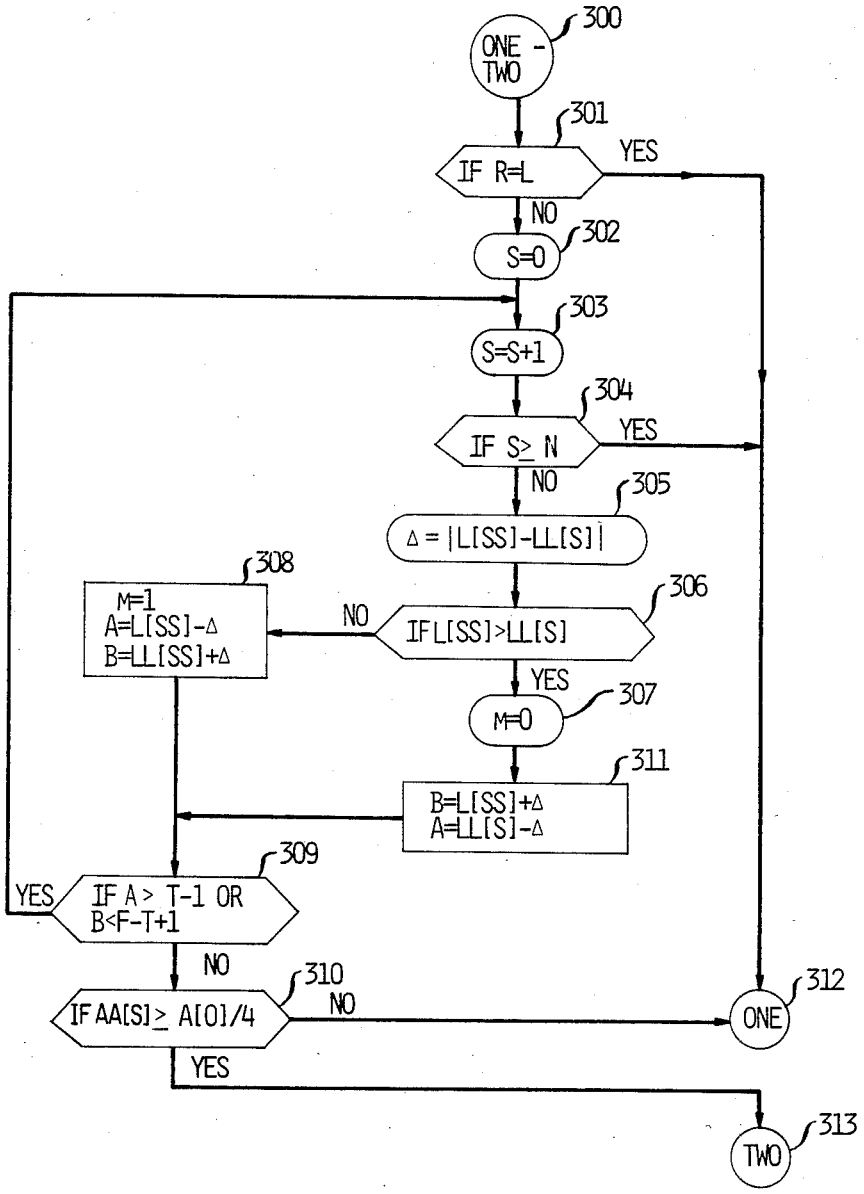
FIG. 10 is a flowchart showing a routine for estimating the periodicity of pulses in the residual wave involving searching when no more than two valid candidate pulses are present.

When the left and right searches fail in the flowcharts of FIGS. 8 and 9, one is directed to the one/two flowchart of FIG. 10. FIG. 10 is a detailed version of block 162 of FIG. 5. A representative array of pulses for this condition is shown in FIG. 7. Four pulses ($N=4$) are shown with the maximum pulse at location 100 and the second highest at location 40. Block 300 is the label for the routine. Decision block 301 tests whether the leftmost and rightmost pulses coincide. If so, the routine terminates with the decision that only one pulse is present. Letting the highest amplitude pulse at location 100 be of order $S=0$ in block 302, proceed to check the next lower amplitude pulse at location 40 according to block 303. If S is greater than N, the total number of candidates, the routine also terminates with the decision that only one successful candidate pulse is present. Here S=1 is less than N=4. Therefore, calculate the distance to the main pulse from block 305. $\Delta=100-40=60$ samples. According to decision block 306, the main sample is farther right than the candidate pulse. Therefore, this fact is established in block 307. The settings block 311 then yield $A=40-60=-20$ and $B=100+60=160$. In decision block 309, both tests fail and the decision is negative. Finally, the test of decision block 310 as to the amplitude of the candidate exceeding one-fourth the maximum pulse confirms the presence of two valid candidates at the distance 60. A distance 60 to the right of the maximum pulse indicates that the next periodic pulse would have to occur beyond the right margin of the frame. Thus, pulse 4 at location 120 is removed as a candidate. A distance 60 to the left of pulse 2 is beyond the left frame margin and thus, pulse 1 is eliminated as a candidate.

For the case of two pulses the pitch period is taken as the difference between the locations of the main pulse and the next higher pulse. For the case of one pulse only that pulse is considered to be the legitimate pulse. In all of the latter cases (block 157 or 159 or 162), the speech frames are considered as voiced. The final decision in obtaining the pitch period estimate is taken in block 163 where information from adjacent frames is utilized while operations continue as indicated in FIG. 5 for the current frame. The final decision refers to an adjacent frame. FIG. 11 illustrates a detailed flowchart for block 164 of FIG. 5.

FIG. 11 is a flowchart showing the examination of the pulse candidates in three adjacent frames indexed as i, i−1, and i−2, the ith frame being the latest frame and the other two being following frames. However, the (i−1)st frame is the subject of the current final decision.

Decision block 402 examines the status with respect to the stored v/u decision of the last (i−2)nd frame.

If it was voiced, then the test of decision diamond 404 is applied. This test compares the difference between the periods determined in frames (i−1) and (i−2). If the difference exceeds an arbitrary amount T′ (which is 3 for low pitches below 200 Hz and 6 for high pitches above 200 Hz), then the (i−1)st frame is declared to be unvoiced in block 405 (by way of connector 407). Otherwise, the (i−1)st frame is declared to be voiced with period $P_{(i-1)}=d_{(i-1)}$ in block 406 by way of connector 408.

Decision block 403 examines the distance between the leftmost pulse in the ith frame and the rightmost pulse in the (i−1)st frame. The distance $d_{(i-1)}$ is the average spacing between the candidate pulses in the (i−1)st frame, F is the number of samples per frame less one (159 in the illustrative example) and T is the breathing space of five samples. An affirmative decision constitutes a final determination through connector 408 that the (i−1)st frame is voiced as indicated in block 406. A negative decision results in a final determination through connector 407 that the (i−1)st frame is unvoiced as indicated in block 405. The results obtained from the application of the flowchart of FIG. 11 are those shown either in block 59 in FIG. 4 or those of blocks 164, 165 and 166 of FIG. 5.

As a further embellishment, decision logic block 59 in FIG. 4 can be programmed to make a comparison of u/v decisions among three adjacent frames for the relatively rare possibilities that the sequences u/v/u or v/u/v may occur. In either of these events there is a significant probability that the center decision is in error and consequently should be changed to match that of its neighbors. These same sequences can readily be monitored and corrected at a receiver or in a synthesizer associated with a voice announcement system to which this invention is applied.

Noise energy is measured in all frames, voiced or unvoiced. In unvoiced frames that total energy is taken as the noise energy. In voiced frames the total energy less the pulse energy is taken as the noise energy.

For the 20-millisecond speech frames of 160-sample width the number of valid pulse candidates ranges from one to eight. Accordingly, the processing can be performed in real time in less than the 20 milliseconds available. The total maximum storage requirement for each frame comes to fewer than 20 bits; one bit for v/u decision; 8 bits for pitch period; 5 bits for noise level; and 5 bits for pulse level.

In summary, each speech frame is examined for pitch pulse candidates greater in magnitude than an arbitrary amount, say 25 percent of the maximum amplitude. This is the only threshold, a relative one as distinguished from an absolute one, required by this invention.

Information about pulse amplitude and location is arranged in order of occurrence. Searching is commenced starting from the pulse of maximum amplitude, first, all pulses to the left and then all pulses to the right, to check distances among the available candidates which are separated by a minimum distance of an arbitrary amount, on the order of 18 sample distances. Periodicity is examined by checking multiples of the distance between the pulses of highest and next highest amplitude against existing pulses to determine substantial coincidence. The quotient of the distance between the extreme left and right pulse candidates and one fewer than the number of valid pulses equals the pitch period. All speech frames are initially regarded as voiced. The pulse amplitude of voiced frames and the noise energy of all frames are sufficient to control the operation of a voice synthesizer.

The flowcharts of FIGS. 5, 8, 9, 10 and 11 and their supporting programs can be implemented on a microprocessor, such as that coded "SPS-61" as aforementioned. A processor of this type operates efficiently enough to perform the processing steps required by this invention, including inverse filtering, Hilbert transformation, LPC coding and pulse matching. The time needed for estimating pitch period for any 20-millisecond speech frame has been found to be only about 4 milliseconds. A realization of this processor in very large scale integrated (VSLI) circuits requires on the order of 30,000 gates.

What is claimed is:

1. A pitch detector for human speech operating on equal-length frames of a speech pattern comprising:

means responsive to the speech pattern for forming a residual wave by substantially removing the formant effects of the vocal tract, means responsive to the residual wave of each successive frame for storing signals representative of the amplitudes and locations of a predetermined number of evenly spaced samples of instantaneous amplitudes of said residual waves of said speech frame, each frame corresponding to the lowest expected fundamental speech frequency, means responsive to said stored residual sample amplitude and location representative signals of the speech frame for locating the residual sample of maximum amplitude within said speech frame, means responsive to the speech frame stored amplitude and location representative signals for selecting and storing a set of residual samples of said speech frame including said maximum amplitude residual sample and residual samples within a predetermined amplitude range of the maximum amplitude residual sample spaced not less than a minimum number of residual samples from the residual sample of maximum amplitude and from each other within said speech frame, said minimum spacing corresponding to the highest expected fundamental speech frequency, means responsive to the location signals of the selected residual samples of the speech frame for detecting a subset of selected residual samples including said residual sample of maximum amplitude having substantially equal spacings between them, and means responsive to the location representative signals of said subset residual samples of the speech frame for generating a signal representative of the quotient of the spacing between extreme subset residual samples within said speech frame and one less than the number of subset residual samples therein to determine the pitch period.

2. A pitch detector for human speech operating on equal-length frames of a speech pattern according to claim 1 wherein said means for selecting and storing said set of residual samples comprises:

means for producing a group of speech frame residual samples from which the residual sample of maximum amplitude of the speech frame and residual samples within a predetermined spacing of said residual sample of maximum amplitude of the speech frame have been removed, means for locating the residual sample of maximum amplitude in the group, means for removing the group residual sample of maximum amplitude and residual samples within a predetermined spacing of said group sample of maximum amplitude from said group and storing said removed sample of maximum amplitude, means for testing the speech frame group of residual samples for samples within a predetermined amplitude range of the speech frame residual sample of maximum amplitude, and means for repeating the operation of said locating, removing and testing means until the group residual samples within said predetermined amplitude range have been removed therefrom.

3. A pitch detector for human speech operating on equal-length frames of the speech pattern according to claim 2 wherein said subset detecting means comprises:

means responsive to the location signals of the speech frame selected residual samples preceding said speech frame residual sample of maximum amplitude for detecting substantially equally spaced speech frame residual samples of the speech frame preceding said speech frame residual sample of maximum amplitude, means responsive to the location signals of the selected residual samples for detecting speech frame residual samples succeeding the speech frame residual sample of maximum amplitude of the same substantially equal spacing as said equally spaced preceding residual samples.

4. A pitch detector for human speech operating on equal-length frames of a speech pattern according to claim 2 wherein said subset forming means comprises:

means responsive to the location signals of the speech frame selected residual samples succeeding said speech frame residual sample of maximum amplitude for detecting substantially equally spaced speech frame residual samples of the speech frame succeeding said speech frame residual sample of maximum amplitude, means responsive to the location signals of the speech frame selected residual samples preceding said speech frame residual sample of maximum amplitude for detecting speech frame residual samples preceding the speech frame residual sample of maximum amplitude of the same substantially equal spacing as said equally spaced succeeding residual samples.

5. A pitch detector for human speech operating on equal-length frames of a speech pattern according to claim 3 or 4 wherein said means for detecting substantially equally spaced speech frame residual samples comprises:

means responsive to the location signals of the residual sample of maximum amplitude and the location signals of one of the selected residual samples for determining the spacing therebetween, and means responsive to said determined spacing for comparing the locations of selected residual samples with multiples of said determined spacing to detect location signals of other selected residual samples within a preselected tolerance of multiples of said determined spacing.

6. A pitch detector for human speech operating on equal-length frames of a speech pattern according to claim 1, 2, 3, or 4 wherein said residual wave generating means comprises:

means responsive to the speech pattern for substantially removing the formant effects of the vocal tract in said speech pattern, and means responsive to said speech pattern with formant effects removed for generating a signal corresponding to the Hilbert transform of said speech pattern with formant effects removed.

7. A method of pitch detection for human speech operating on equal-length frames of a speech pattern comprising the steps of:

forming a residual wave by substantially removing the formant effects of the vocal tract responsive to the speech pattern, responsive to the residual wave of each successive frame, storing signals representative of the amplitudes and locations of a predetermined number of evenly spaced samples of instantaneous amplitudes of said residual wave of said speech frame, each frame corresponding to the lowest expected fundamental speech frequency, locating the residual sample of maximum amplitude within said speech frame responsive to said stored residual sample amplitude and location representative signals of the speech frame, responsive to the speech frame stored amplitude and location representative signals, selecting and storing a set of residual samples of said speech frame including said maximum amplitude residual sample and residual samples within a predetermined amplitude range of the maximum amplitude residual sample spaced not less than a minimum number of residual samples from the residual sample of maximum amplitude and from each other within said speech frame, said minimum spacing corresponding to the highest expected fundamental speech frequency, detecting a subset of selected residual samples including said residual sample of maximum amplitude having substantially equal spacings between them responsive to the location signals of the selected residual samples of the speech frame, and responsive to the location representative signals of said subset residual samples of the speech frame, generating a signal representative of the quotient of the spacing between extreme subset residual samples within said speech frame and one less than the number of subset residual samples therein to determine the pitch period.

8. A method of pitch detection for human speech operating on equal-length frames of a speech pattern according to claim 7 wherein the said selecting and storing of said set of residual samples comprises the steps of:

locating the residual sample of maximum amplitude in the group of residual samples of the speech frame, removing from the group the residual sample of maximum amplitude and residual samples within a predetermined spacing of said group sample of maximum amplitude from said group and storing said removed maximum amplitude sample, testing the speech frame group of residual samples for residual samples within a predetermined amplitude range of the residual sample of maximum amplitude of said speech frame, and repeating said locating, removing and testing steps until the group residual samples within said predetermined amplitude range have been removed from said group.

9. A method for pitch detection of human speech within equal length frames of a speech pattern according to claim 7 or claim 8 wherein the residual wave generating step comprises:

removing the formant effects of the vocal tract from said speech pattern, and forming a signal corresponding to the Hilbert transform of the speech pattern with formant effects removed.

* * * * *

UNITED STATES PATENT AND TRADEMARK OFFICE

CERTIFICATE OF CORRECTION

PATENT NO. : 4,561,102

DATED : December 24, 1985

INVENTOR(S) : Dimitrios P. Prezas

It is certified that error appears in the above-identified patent and that said Letters Patent is hereby corrected as shown below:

In the Abstract, delete in its entirety, and it should read

--Speech signal pitch detection uses the residual signal output of an LPC (linear prediction coder) filter. The residual signal (or its Hilbert transform) is divided into frames of 20 milliseconds, and each frame searched for signal peak periodicity by first detecting the highest peak, then detecting a set of equally-spaced selected samples from which the pitch period is determined. If no periodicity is found over three frames, an unvoiced decision is made.--.

Signed and Sealed this

Twenty-fourth Day of March, 1987

*Attest:*

DONALD J. QUIGG

*Attesting Officer* *Commissioner of Patents and Trademarks*